US009249619B2

(12) United States Patent
Chang

(10) Patent No.: US 9,249,619 B2
(45) Date of Patent: Feb. 2, 2016

(54) WINDOW COVERING

(71) Applicant: NIEN MADE ENTERPRISE CO., LTD., Taichung (TW)

(72) Inventor: Chih-Yao Chang, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 14/267,477

(22) Filed: May 1, 2014

(65) Prior Publication Data

US 2014/0332170 A1 Nov. 13, 2014

(30) Foreign Application Priority Data

May 8, 2013 (CN) ..... 2013 2 0245785 U

(51) Int. Cl.

| | |
|---|---|
| ***E06B 9/322*** | (2006.01) |
| ***E06B 9/38*** | (2006.01) |
| ***E06B 9/262*** | (2006.01) |
| *E06B 9/32* | (2006.01) |

(52) U.S. Cl.

CPC . *E06B 9/38* (2013.01); *E06B 9/262* (2013.01); *E06B 9/322* (2013.01); *E06B 9/32* (2013.01)

(58) Field of Classification Search

CPC ..... E06B 9/32; E06B 9/322; E06B 9/262; E06B 9/303; E06B 9/38; E06B 9/326; E06B 9/30

USPC ..... 160/176.1 R, 177 R, 170, 171, 168.1 R, 160/173 R

See application file for complete search history.

(56) References Cited

U.S. PATENT DOCUMENTS

| | | | | |
|---|---|---|---|---|
| 2,594,637 | A * | 4/1952 | Gertzon | 160/168.1 R |
| 4,333,510 | A * | 6/1982 | Fox | 160/177 R |
| 4,567,930 | A * | 2/1986 | Fischer | 160/166.1 |
| 4,621,673 | A * | 11/1986 | Georgopoulos et al. | 160/168.1 R |
| 4,643,238 | A * | 2/1987 | Tachikawa et al. | 160/168.1 R |
| 5,103,888 | A * | 4/1992 | Nakamura | 160/171 |
| 5,133,399 | A * | 7/1992 | Hiller et al. | 160/171 |
| 5,228,491 | A * | 7/1993 | Rude et al. | 160/171 |
| 5,538,066 | A * | 7/1996 | Liu | 160/173 R |
| 5,671,793 | A * | 9/1997 | Lee | 160/168.1 R |
| 5,799,715 | A * | 9/1998 | Biro et al. | 160/170 |
| 6,095,228 | A * | 8/2000 | Liu | 160/173 R |
| 6,158,494 | A * | 12/2000 | Huang | 160/84.05 |
| 6,189,596 | B1 * | 2/2001 | Chen | 160/176.1 R |
| 6,802,356 | B2 * | 10/2004 | Lin | 160/168.1 R |
| 6,837,294 | B2 * | 1/2005 | Cheng et al. | 160/84.04 |
| 6,962,187 | B2 * | 11/2005 | Gilmore et al. | 160/170 |
| 6,991,020 | B1 * | 1/2006 | Cheng et al. | 160/168.1 R |
| 7,025,107 | B2 * | 4/2006 | Ciuca | 160/170 |
| 7,028,739 | B2 * | 4/2006 | Hsu | 160/173 R |
| 7,100,664 | B2 * | 9/2006 | Hsu | 160/115 |

(Continued)

*Primary Examiner* — Katherine Mitchell
*Assistant Examiner* — Johnnie A Shablack
(74) *Attorney, Agent, or Firm* — Ming Chow Sinorica, LLC

(57) ABSTRACT

A window covering includes a headrail, a bottom rail, a shading member, two pulley assemblies, a car, a control cord, and a transmission cord. The shading member is between the headrail and the bottom rail. The pulley assemblies and the car are received in the headrail, and the car is free for reciprocation. The control cord runs around one of the pulley assemblies and the car, and then going out of the headrail to be pulled or released by a user. The transmission cord has a main section and two branch sections, wherein the main section runs around the other one of the pulley assemblies and the car, and the branch sections go out of the headrail to be connected to the bottom rail.

14 Claims, 16 Drawing Sheets

(56) References Cited

U.S. PATENT DOCUMENTS

| | | | | |
|---|---|---|---|---|
| 7,168,476 | B2 * | 1/2007 | Chen | 160/170 |
| 7,258,297 | B2 * | 8/2007 | Liu | 242/398 |
| 7,264,035 | B2 * | 9/2007 | Rossato et al. | 160/178.2 |
| 7,343,957 | B2 * | 3/2008 | Lin | 160/168.1 R |
| 7,398,815 | B2 * | 7/2008 | Liang | 160/170 |
| 7,424,905 | B2 * | 9/2008 | Lai | 160/168.1 R |
| 7,487,817 | B2 * | 2/2009 | Liang | 160/170 |
| 7,493,932 | B2 * | 2/2009 | Cheng | 160/173 R |
| 7,624,785 | B2 * | 12/2009 | Yu et al. | 160/171 |
| 7,832,453 | B2 * | 11/2010 | Lin | 160/168.1 R |
| 7,913,738 | B2 * | 3/2011 | Fraser et al. | 160/115 |
| 7,984,745 | B2 * | 7/2011 | Wen et al. | 160/170 |
| 8,002,012 | B2 * | 8/2011 | Cheng | 160/170 |
| 8,267,145 | B2 * | 9/2012 | Fraser et al. | 160/115 |
| 8,919,416 | B2 * | 12/2014 | Chen | 160/170 |
| 8,925,615 | B2 * | 1/2015 | Lin | 160/170 |
| 8,931,539 | B1 * | 1/2015 | Jaggli | 160/168.1 R |
| 8,997,826 | B2 * | 4/2015 | Chang | 160/168.1 R |
| 2003/0062137 | A1 * | 4/2003 | Su et al. | 160/178.1 R |
| 2005/0145345 | A1 * | 7/2005 | Chen | 160/173 R |
| 2007/0095486 | A1 * | 5/2007 | Huang et al. | 160/171 |
| 2007/0119547 | A1 * | 5/2007 | Liang | 160/170 |
| 2008/0073038 | A1 * | 3/2008 | Cheng | 160/168.1 R |
| 2011/0315329 | A1 * | 12/2011 | Hong et al. | 160/340 |
| 2012/0118515 | A1 * | 5/2012 | Chen | 160/170 |
| 2013/0313497 | A1 * | 11/2013 | Hsu et al. | 254/394 |
| 2014/0246156 | A1 * | 9/2014 | Dorny et al. | 160/172 R |
| 2014/0332170 | A1 * | 11/2014 | Chang | 160/84.02 |
| 2015/0020980 | A1 * | 1/2015 | Franssen | 160/84.01 |

* cited by examiner

WINDOW COVERING

The current application claims a foreign priority to the patent application of China No. 201320245785.X filed on May 8, 2013.

BACKGROUND OF THE INVENTION

1. Technical Field

The present invention relates to a covering of a building opening, and more particularly to a window covering which is operated in an easy and less-strength way.

2. Description of Related Art

A conventional window covering includes a headrail, a bottom rail, and slats between the headrail and the bottom rail. The conventional window covering usually has two cords, each of which has an end fixed to the bottom rail, and then passing through the slats (this section is called lift cord), running over pulleys in the headrail, and then extending out of the headrail (this section is called control cord). Therefore, a user may pull or release the control cords to lift or lower the bottom rail.

In the view of consumers, except the look of the covering, the function and operation are important issues when they are going to buy a window covering. For example, whether the cord is easy to be pulled is an important concern when the consumers choose the window covering with the cords.

For the balance of the bottom rail, there needs two or more cords in the conventional window covering, which means there will be a plurality of control cords. The control cords are always easily getting twist after pulling or releasing for several times, and the twisted control cords are harmful to lift and lower the bottom rail. Furthermore, multiple control cords may lead to accidents. Children might be strangled by the loop created by the twisted control cords. In addition, sometime the control cords are not moved synchronously, and that will make the bottom rail lean. In some window coverings, they provide a cord connector to collect the control cords, however, it only has limited function.

BRIEF SUMMARY OF THE INVENTION

In view of the above, the primary objective of the present invention is to provide a window covering without the drawback of multiple control cords of the conventional window covering.

In order to achieve the objective of the present invention, a window covering including a headrail; a bottom rail; a shading member between the headrail and the bottom rail; two pulley assemblies received in the headrail, and each having a sliding member; a car received in the headrail for reciprocation, and having two second sliding members; a control cord running around the first sliding member of one of the pulley assemblies and one of the second sliding members of the car, and then going out of the headrail to form the control cord; and a transmission cord having two branch sections, wherein the branch sections running around the first sliding member of the other one of the pulley assemblies and the other one of the second sliding members of the car, and then going out of the headrail to be connected to the bottom rail.

In an embodiment, each of the pulley assembly further has a first frame, in which the first sliding member is received; the first frame has an opening for the corresponding branch section of the transmission cord to pass.

In an embodiment, the first frame of each of the pulley assembly is provided with two locking slots at an inner side thereof; each of the first sliding members has a wheel and a flange on a tread of the wheel; the flange engages the locking slots; the flange divides the tread of the wheel into two cord treads, and the control cord runs around one of the cord treads of the first sliding member, and the transmission cord runs around the other one of the cord treads of the first sliding member.

In an embodiment, the cord treads of the first sliding member respectively slope toward flange.

In an embodiment, the wheel further has two edge flanges at opposite edges of the tread thereof.

In an embodiment, the first frame of each of the pulley assemblies further has two second locking slots on the inner side; an axle, which is connected to the sliding member, having opposite ends engaging the second locking slots respectively.

In an embodiment, each of the second locking slots has an open end and a closed end; a width at the open end is wider than that at the closed end; the axle engages the second locking slot via the open end and stops at the closed end.

In an embodiment, the window covering further includes a tilting assembly and two ladders, wherein the tilting assembly has two fixed cores, a shaft, and a control unit; the fixed cores are received in the headrail; the shaft is connected to the fixed cores; an end of the shaft passes through the corresponding fixed core, and then is connected to the control unit; the ladders have ends connected to fixed cores respectively, and then pass through the shading member to be connected to the bottom rail.

In an embodiment, the first frame of each of the pulley assemblies further includes a carrying portion to receive the fixed core.

In an embodiment, the window covering further includes a cord lock to hold or release the control cord.

In an embodiment, the transmission cord further has a main section; both the branch sections are connected to an end of the main section; the main section runs around the first sliding member of the other one of the pulley assemblies and the other one of the second sliding member of the car.

In an embodiment, the main section and the branch sections are made by sewing, knotting, bonding, or gluing a plurality of filaments.

In an embodiment, the main section and the branch sections are flat.

In an embodiment, the window covering further includes a separating member between the branch sections.

In an embodiment, the car further has a second frame, in which the second sliding member is received.

With such design, it may prevent multiple cords' twisting, lower the chance of a malfunction, and make the replacement easier.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
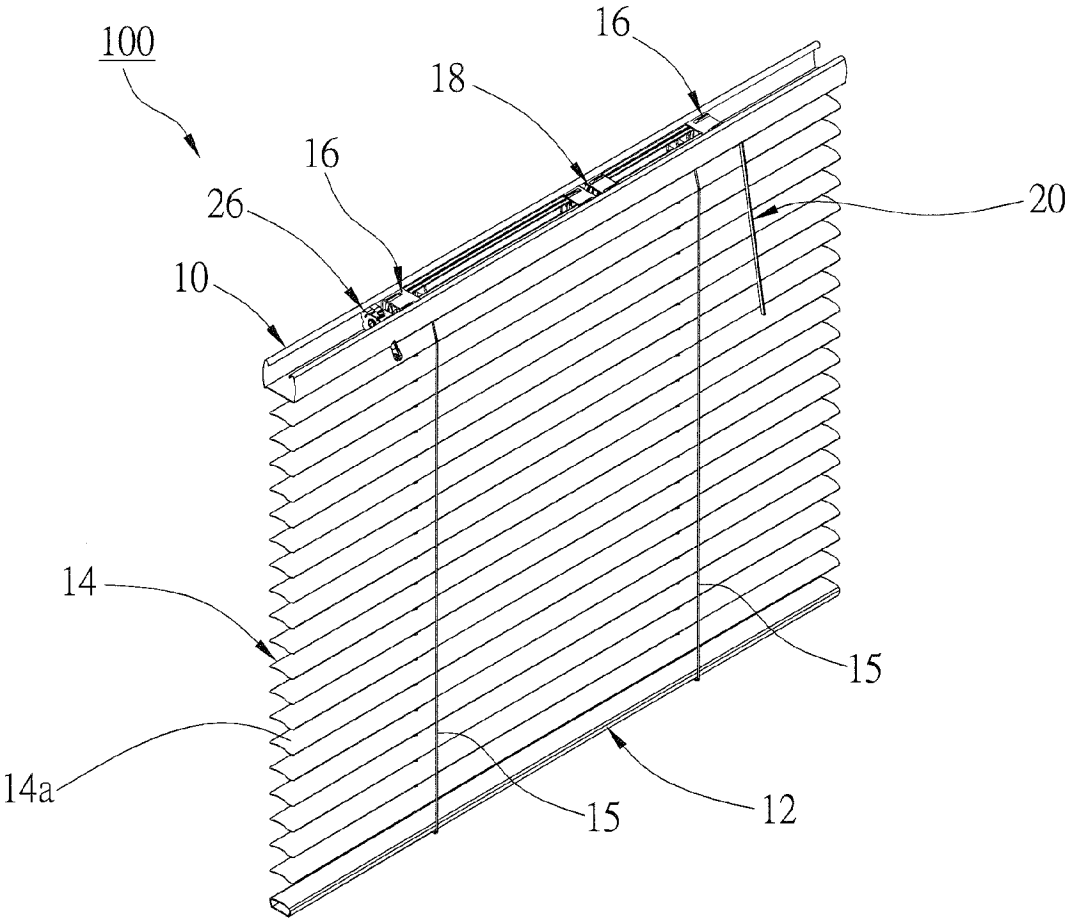
FIG. 1 is a perspective view of a first preferred embodiment of the present invention.

As shown in FIG. 1 to FIG. 4, a window covering 100 of the first preferred embodiment of the present invention includes a headrail 10, a bottom rail 12, a shading member 14, two pulley assemblies 16, a car 18, a control cord 20, a cord lock 22, a transmission cord 24, a tilting assembly 26, and a plurality of separating members 28.

The headrail 10 is fixed on a wall. The shading member 14 has a plurality of parallel slats 14*a*, which are between the headrail 10 and the bottom rail 12, and are connected to the headrail 10 and the bottom rail 12 through two ladders 15. The ladders 15 make the slats 14*a* tilt.

Figure 5:
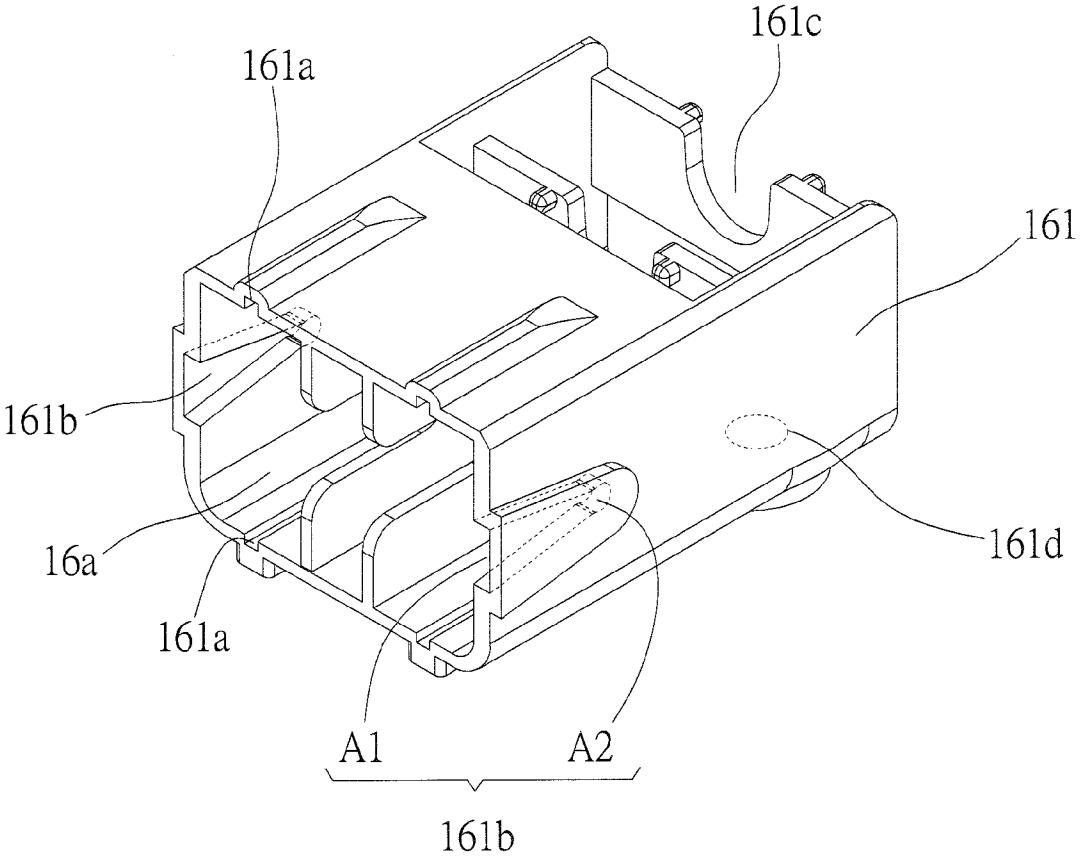
FIG. 5 is a perspective view of the first frame of the first preferred embodiment of the present invention.

The pulley assemblies 16 are received in the headrail 10, each of which has a first frame 161, a sliding member 162, and an axle 163. As shown in FIG. 5, the first frame 161 is a rectangular hollow member, having four walls at a top, a bottom, a left, and a right thereof, and has a room 16*a* within the walls. On inner sides of the top and bottom walls each has two first locking slots 161*a*, and on inner sides of the left and right walls each has a second locking slot 161*b*. Each second locking slot 161*b* has an opened end A1 and a closed end A2, and a width of the second locking slot 161*b* gradually increases from the closed end A2 to the opened end A1. The first frame 161 further has a carrying portion 161*c*, which is a recess on a top of a rear wall, and a plurality of openings 161*d* on the bottom wall and adjacent to the rear wall. The rear wall is connected to the left and right walls, and is not connected to the top and bottom walls, so that two openings are formed on the first frame 161, one of the openings is on a top side of the first frame 161 between the top wall and the rear wall, and the other opening is on a rear side of the first frame 161 between the bottom wall and the rear wall.

Figure 6:
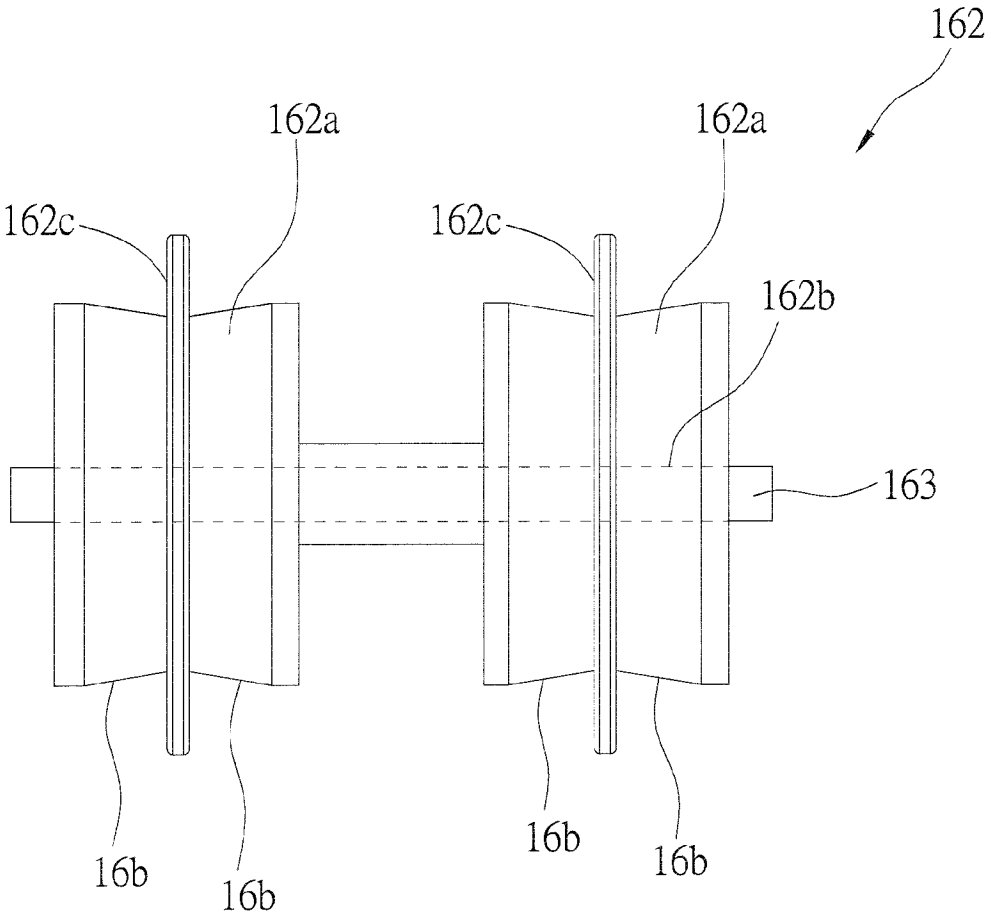
FIG. 6 is a lateral view of the first sliding member of the first preferred embodiment of the present invention.
Figure 7:
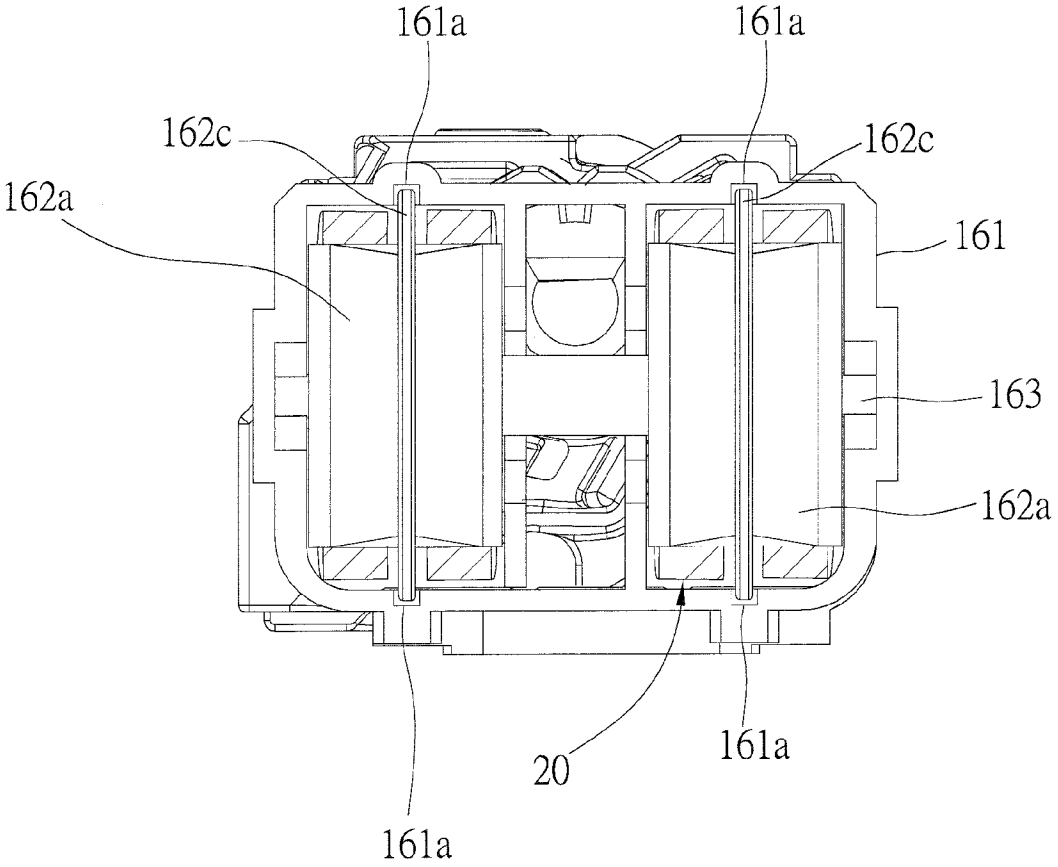
FIG. 7 is a lateral view of the first preferred embodiment of the present invention, showing the first sliding member installed in the first frame.

As shown in FIG. 6, the first sliding member 162 has two wheels 162 and an axial bore 162*b* through centers of the wheels 162, and the axle 163 is inserted into the axial bore 162*b*. Opposite ends of the axle 163 enter the second locking slots 161*b* from the opened ends A1 respectively and stop at the closed ends A2 to receive the wheels 162 in the room 16*a* of the first frame 161 for free rotation. The tapered second locking slots 161*b* are helpful to the installation of the first sliding member 162. Each wheel 162*a* is provided with a flange 162*c* on a tread thereof, and the flanges 162*c* are engaged with the first locking slots 161*a* to stabilize the rotations of the wheels 162*a*. The tread of each wheel 162*a* is a concave surface, and the flange 162*c* is at the lowest portion of the concave surface. In other words, the tread is divided by the flange 162*c* to have two cord treads 16*b*, and the cord treads 16*b* slope toward flange 162*c* respectively.

In practice, the pulley assemblies 16 could work without the first frames, that is, the axle 163 of each pulley assembly 16 could be fixed to a wall of the headrail 10, and the wheels 162 are connected to the corresponding axes 163 respectively.

Figure 8:
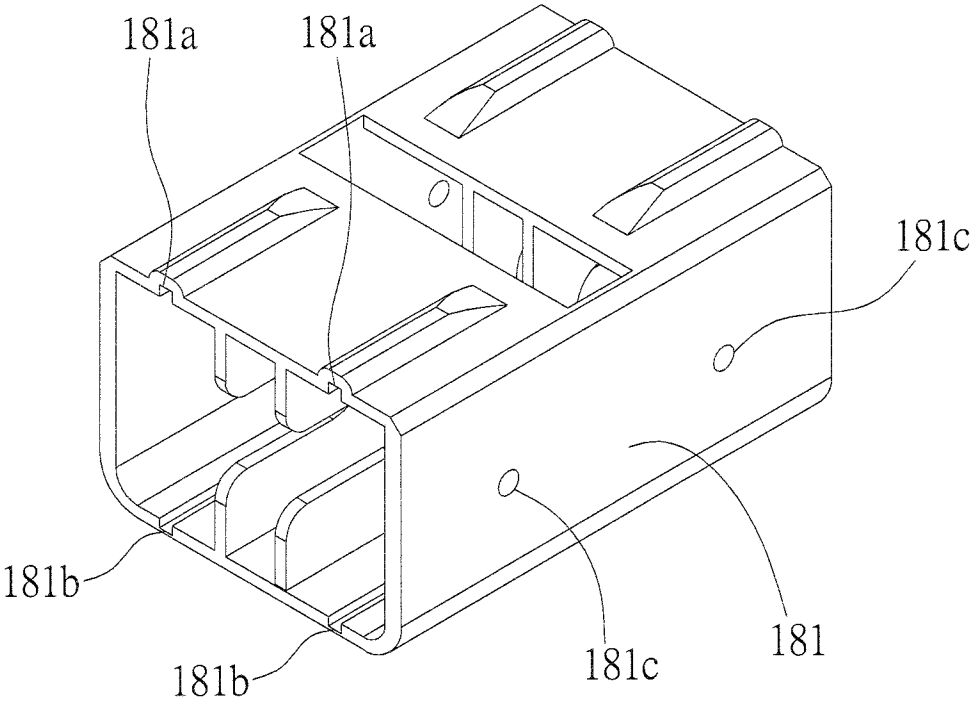
FIG. 8 is a perspective view of the second frame of the first preferred embodiment of the present invention.

The car 18 is received in the headrail 10 for reciprocation between the pulley assemblies 16. The car 18 has a second frame 181 and two second sliding members 182, 182' received in the second frame 181. As shown in FIG. 8, the second frame 181 is a rectangular hollow member, having four walls at a top, a bottom, a left, and a right thereof. On an inner side of the top wall has two upper locking slots 181*a*, on an inner side of the bottom wall has two lower locking slots 181*b*, and on the left and right walls each has two lateral bores 181*c*. The second sliding members 182, 182' are the same as the first sliding members 162 each having two wheels 182*a* and an axial bore 182*b* through the wheels 182*a*. The wheels 182*a* are received in the second frame 181, and an axle 10 is inserted into the lateral bores 181*c* and the axial bore 182*b* to let the wheels 182*a* rotate freely in the second frame 181. Each wheel 182*a* is provided with a flange 183*c* as well to engage the upper and the lower slots 181*a*, 181*b*. In an embodiment, the lateral bores 181*c* of the second frame 181 are replaced by the second locking slots 161*b* of the first frame 161.

Figure 2:
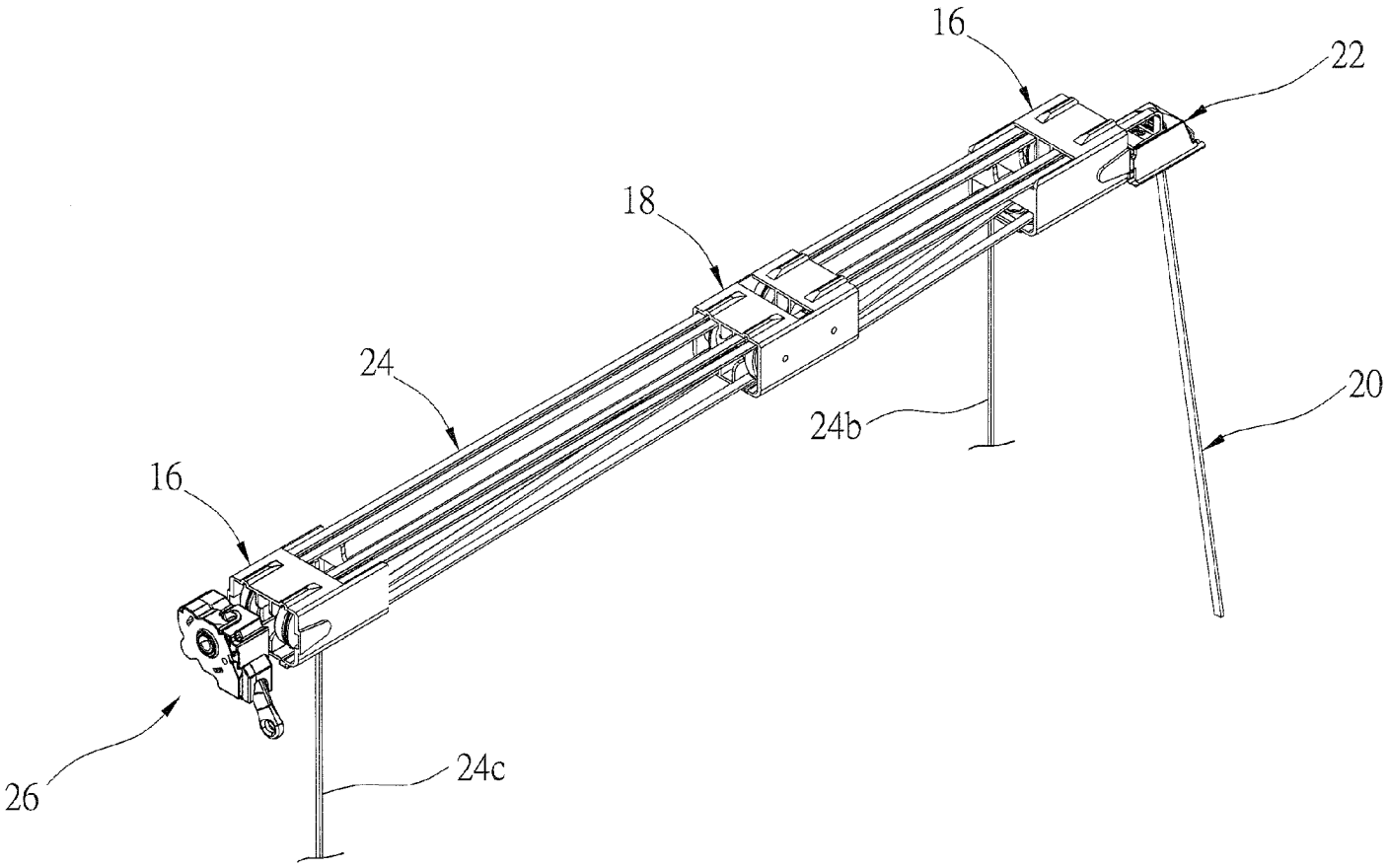
FIG. 2 is a perspective view of the first preferred embodiment of the present invention, showing the mechanism in the headrail.
Figure 3:
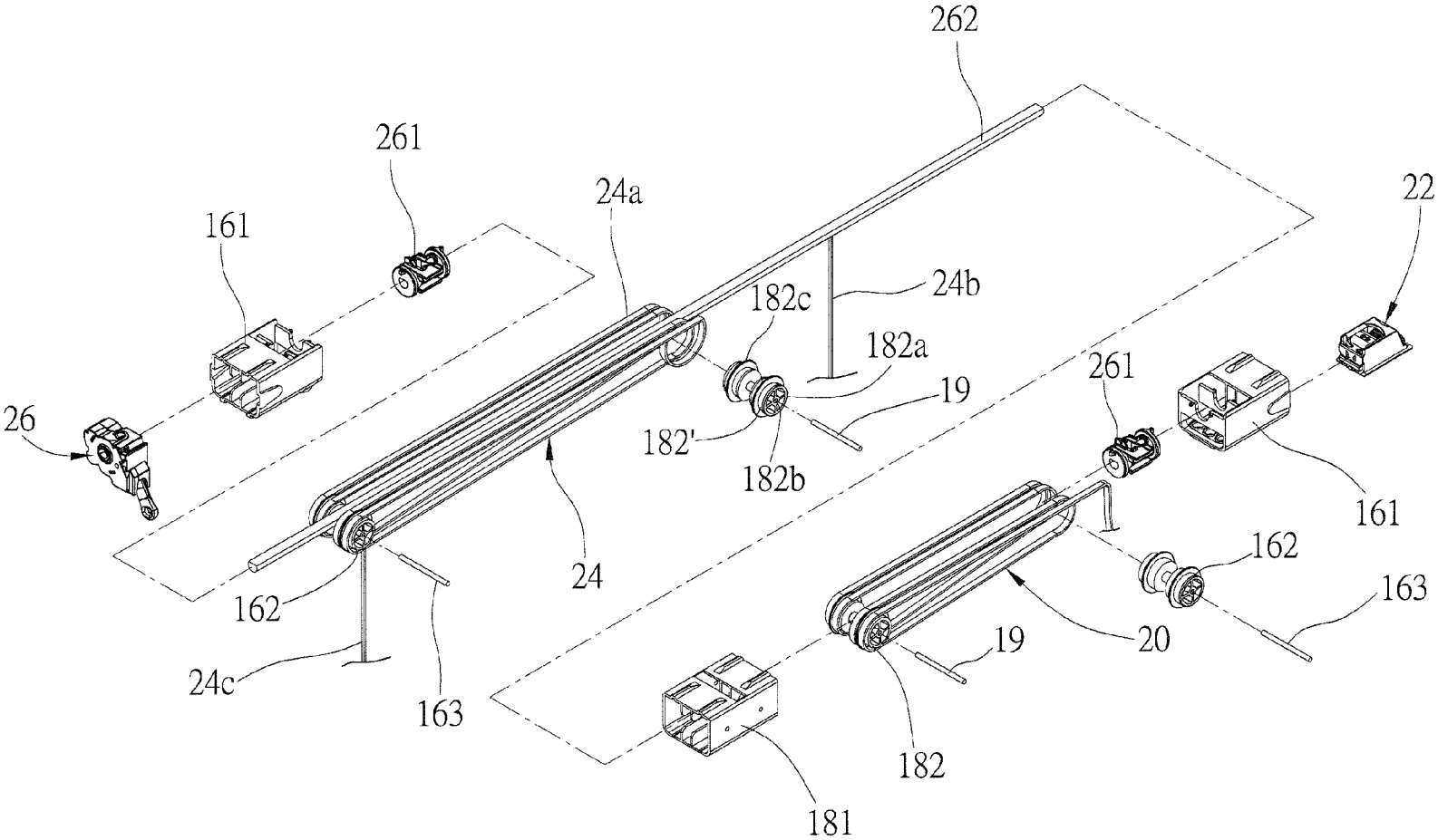
FIG. 3 is an exploded view of FIG. 2.
Figure 4:
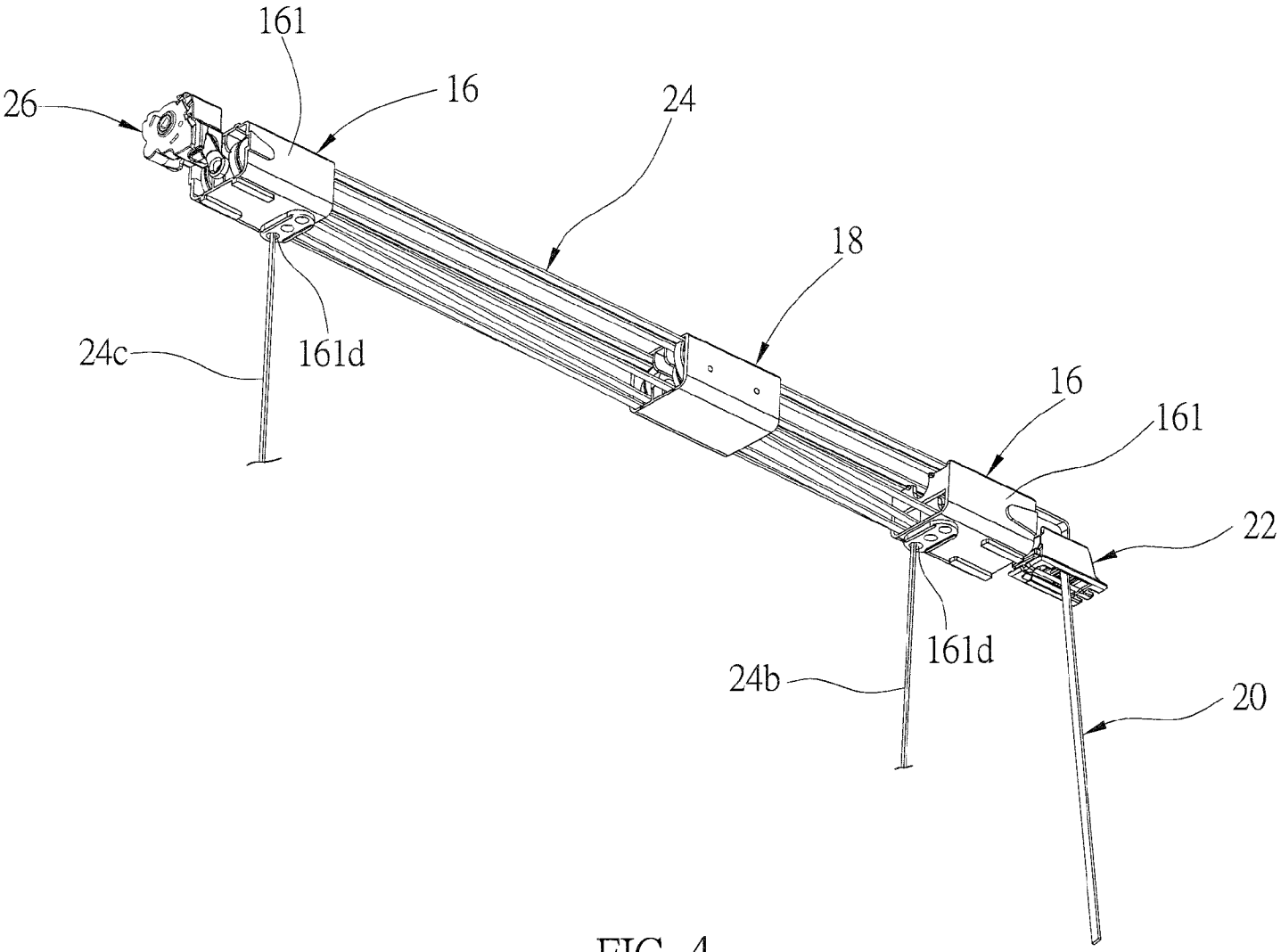
FIG. 4 is another perspective view of FIG. 2.

As shown in FIG. 2 and FIG. 3, the control cord 20 has an end fastened to the second sliding members 182 of the car 18, and then runs around second sliding member 182 and the first sliding member 162 of the right pulley assembly 16 to form a plurality of loops, passes through the cord lock 22, and goes out of the headrail 10 for user to hold it to pull or release. More specifically, each of the plurality of loops surrounds around the first sliding member 162 and the second sliding member 182 of the car 18. The cord lock 22 is a conventional device to hold or release the control cord 20. The flanges 162*c*, 183*c* of the first and the second sliding member 162, 182 may separate the control cord 20 wound on the wheels to prevent the control cord 20 from twisting, and the sloping cord treads may prevent the control cord 20 from escaping from the wheels. It may ensure smooth movements of these elements while the user pulls or releases the control cord 20. In an embodiment, the control cord 20 is flat, which is made of a plurality of twisted filaments.

Figure 9:
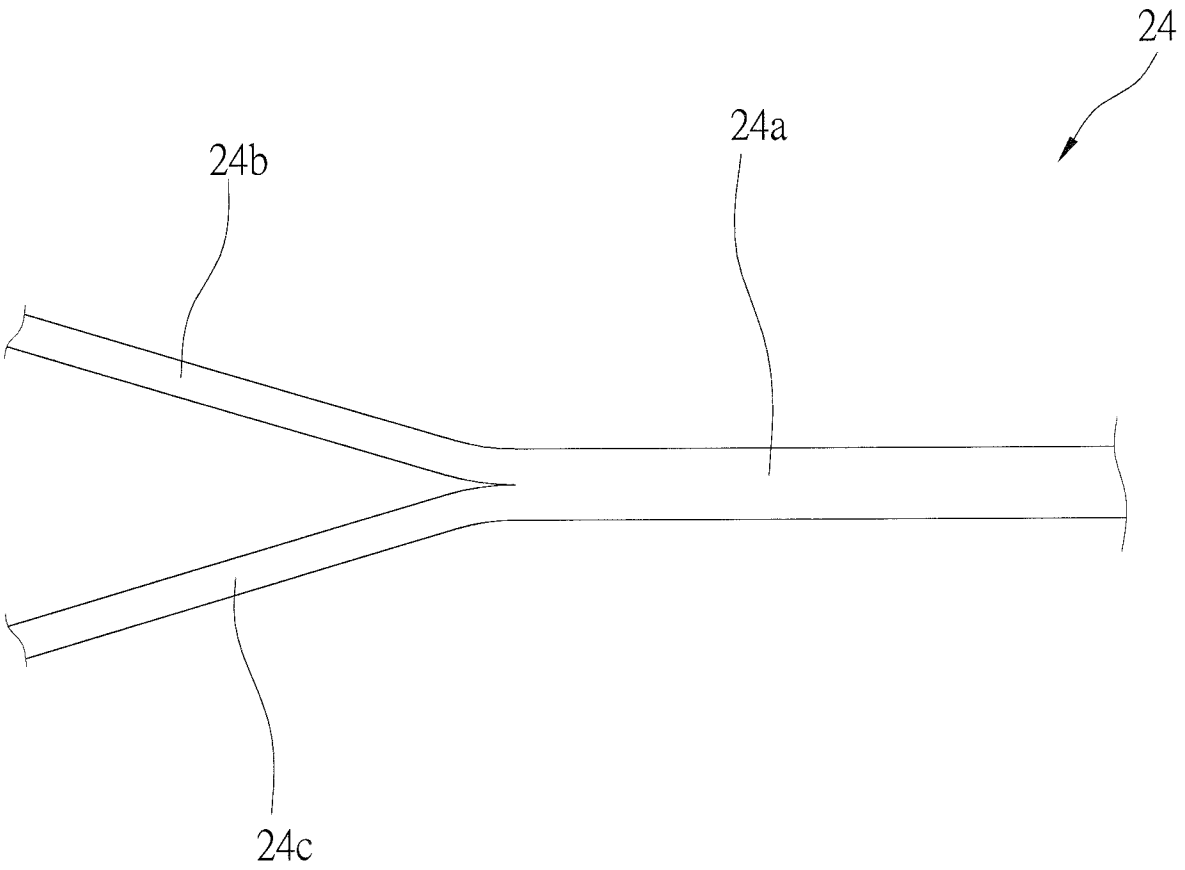
FIG. 9 is a lateral view of the transmission cord of the first preferred embodiment of the present invention.

The transmission cord 24 runs around the first sliding member 162 of the left pulley assembly 16 and the second sliding member 182' of the car 18. As shown in FIG. 9, the transmission cord 24 is a single Y-shaped belt having a main section 24*a* and two branch sections 24*b*, 24*c* connected to an end of the main section 24*a*. A width of the main section 24*a* is larger than that of the branch sections 24*b*, 24*c*. A distal end of the main section 24*a* is fastened to the second sliding member 182', and the branch sections 24*b*, 24*c* pass through the openings 161*d* of the first frames 161 respectively, and then go out of the headrail 10, pass through the slats 14*a*, and finally are fastened to the bottom rail 12. While the car 18 is moving because the control cord 20 is pulled or released, the bottom rail 12 will be lifted or lowered to fold and unfold the window covering 100.

However, the transmission cord 24 may include the branch sections 24*b*, 24*c* only. Each branch section 24*b*, 24*c* has an end passing through the corresponding first frame 161, the headrail 10, and the slats 14*a* in sequence before they are fastened to the bottom rail 12. The branch sections 24*b*, 24*c* run around the first sliding member 162 of the left pulley assembly 16 and the second sliding member 182' of the car 18 for several loops, and then the branch sections 24*b*, 24*c* are selectively fastened to an inner wall of the headrail 10, the first frame 161 of the pulley assembly 16, or the second frame 181 of the car 18. In an embodiment, the branch sections 24*b*, 24*c* are directly fastened to the second frame 181 of the car 18. In an embodiment, the ends of the branch sections 24*b*, 24*c* which are fastened to the second frame 181 of the car 18, are located at a plane, and the plane is vertical to an elongated direction of the headrail 10. With this structure, the transmission cord 24 may achieve the same function without the main section 24*a*.

Figure 10:
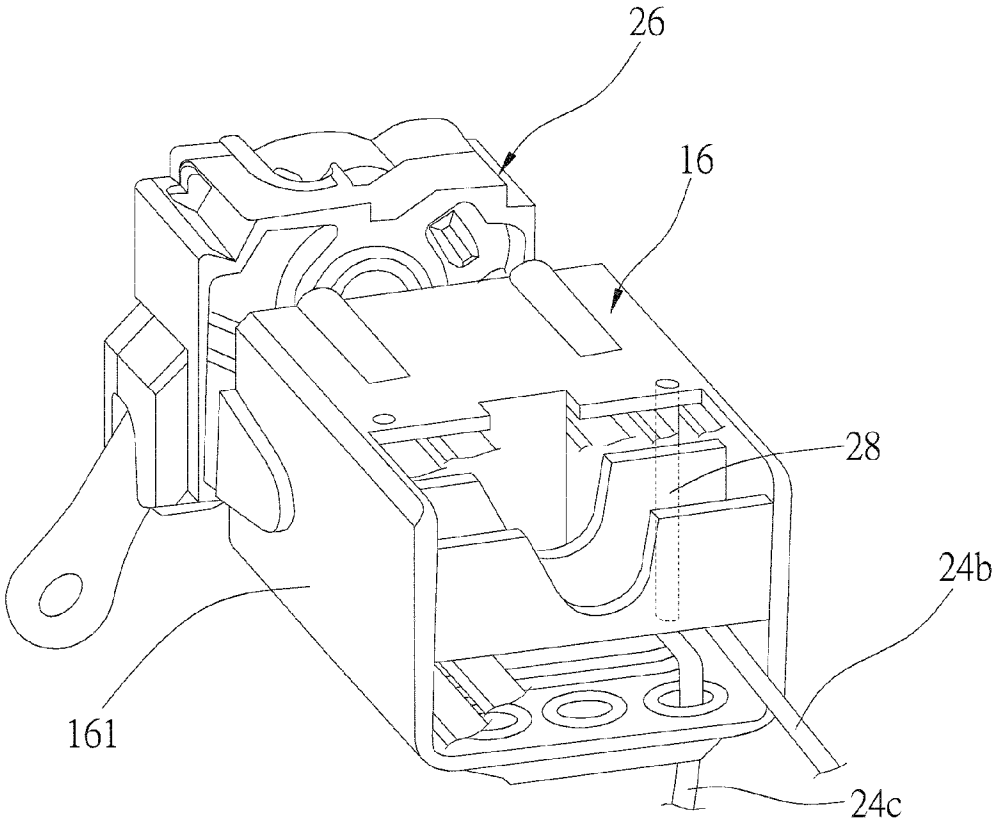
FIG. 10 is a perspective view of the first preferred embodiment of the present invention, showing the arrangement of the separating member.

As shown in FIG. 10, the separating member 28 are posts vertically connected to the first frame 161 of the left pulley assembly 16, and the branch sections 24*b*, 24*c* go separately by the separating members 28. The purpose of the separating members 28 is to prevent the branch sections 24*b*, 24*c* from twisting. The flanges and the cord treads on the sliding members provide the branch sections 24*b*, 24*c* with the same functions. The flat transmission cord 24 provides a larger area in touch with the wheels of the sliding members that may make the transmission cord 24 moves much smoothly.

The transmission cord 24 is made by sewing, knotting, bonding, or gluing a plurality of filaments to form a single cord, so that the transmission cord 24 is very strong to sustain a large pull force. Preferable, the transmission cord 24 is made of twisted filaments. Unlike the prior art which attaches or sews the branch sections to the main section, the transmission cord 24 of the present invention could move smoothly on the sliding members.

The control cord 20 and the transmission cord 24 could run around the sliding members for several loops. The number of the loops relates to the specifications of the window covering, furthermore, the number of the loops affects the strength the user pulls the control cord 20. For a window covering with small and light slats 14*a*, it could reduce the number of the loops. With less loops, the bottom rail 12 will be moved faster. On the contrary, with more loops, it may lift and lower the heavy slats 14*a* and the bottom rail 12 with a small strength, but they are moved slower. In addition, the Y-shaped transmission cord 24 may balance the forces exerted on the bottom rail 12 to prevent the bottom rail 12 from leaning while the bottom rail 12 is being lifted or lowered.

Figure 11:
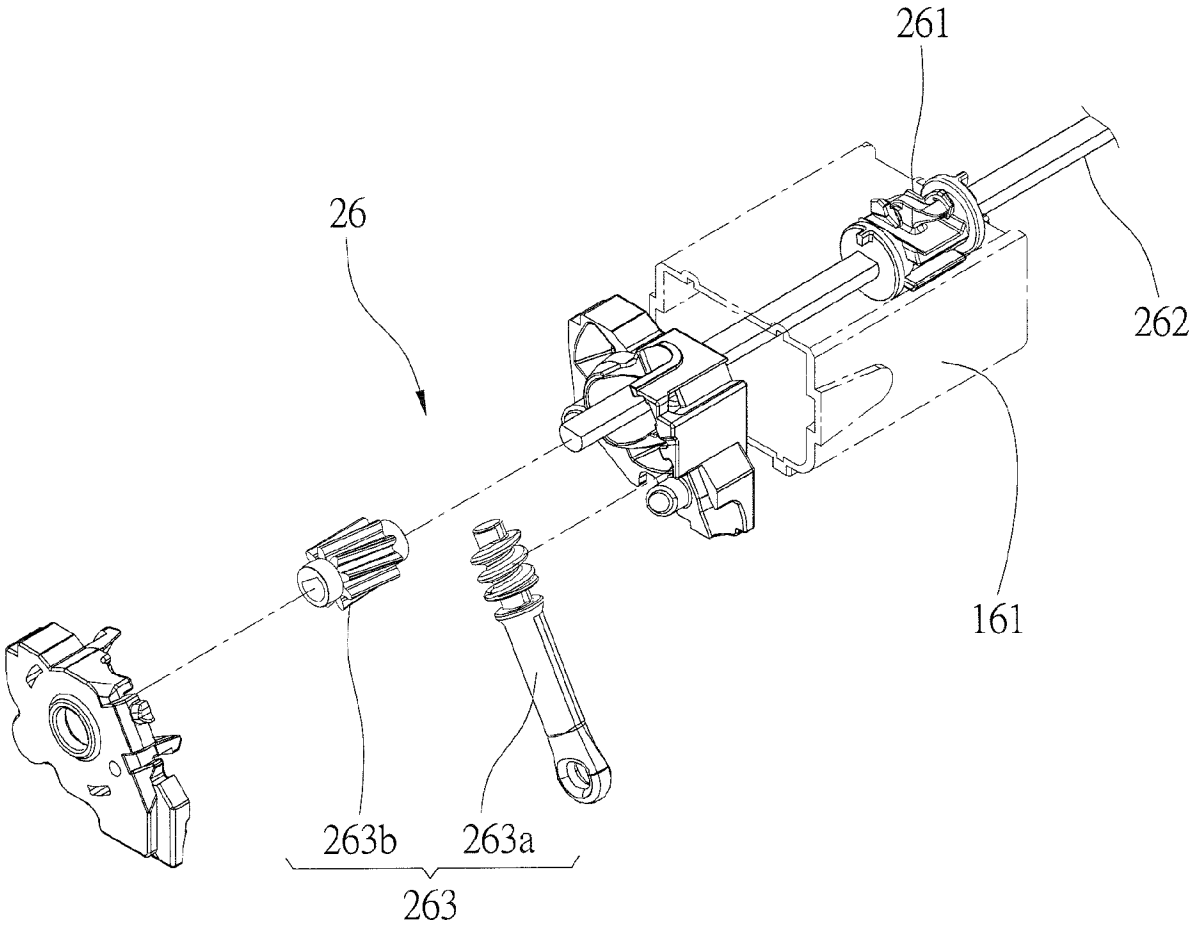
FIG. 11 is an exploded view of the tilting assembly of the first preferred embodiment of the present invention.

As shown in FIG. 11, the tilting assembly 26 has two fixed cores 261, a shaft 262, and a control unit 263. The fixed cores 261 are received in the headrail 10 and rested in the carrying portions 161*c* of the first frames 161 respectively. The ladders 15 have ends fastened to the fixed cores 261 respectively (not shown). Both the fixed cores 261 are connected to the shaft 262, and an end of the shaft 262 passes through one of the fixed cores 261 and is connected to the control unit 263. The control unit 263 includes a worm rod 263*a* and a gear 263*b*. The gear 263*b* is meshed with the worm rod 263*a* and connected to the shaft 262. The worm rod 263*a* is turned to drive the gear 263*b* to turn, and then the fixed cores 261 are turned through the shaft 262. As a result, the ladders 15 will tilt the slats 14*a*.

Figure 12:
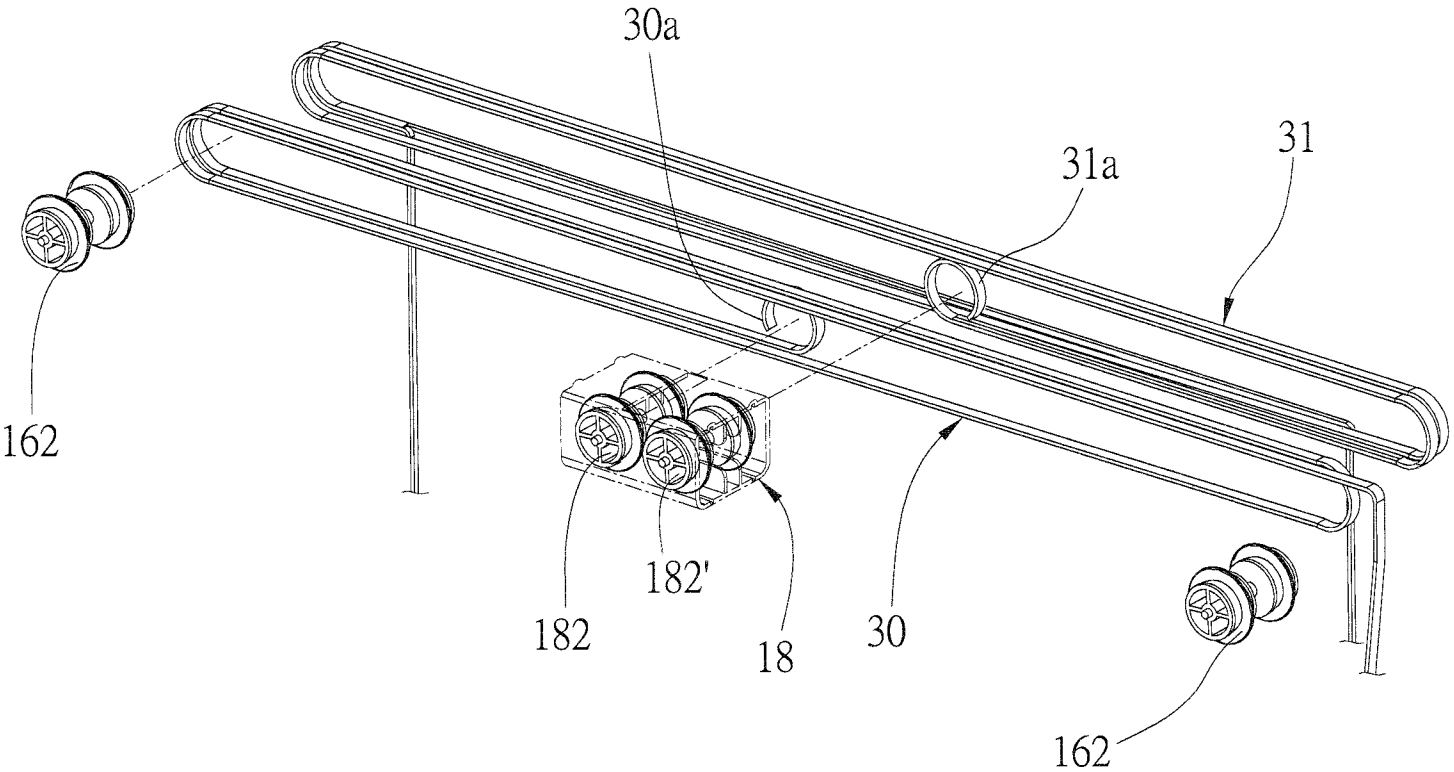
FIG. 12 is a perspective view of a second preferred embodiment of the present invention, showing the control cord and the pulley assemblies.

FIG. 12 shows a window covering of the second preferred embodiment of the present invention, which is similar to the first preferred embodiment, except for the running of the control cord 30. As shown in FIG. 12, the control cord 30 has an end 30*a* fastened to the second sliding member 182 of the car 18, and then runs around the first sliding member 162 of the left pulley assembly 16 and the first sliding member 162 of the right pulley assembly 16 twice before it goes out of the headrail (not shown). The same function will be achieved with this type of the running of the control cord 30. The running of the transmission cord 31 is the same as above, an end 31*a* of the main section 31 is fastened to the second sliding member 182 of the car 18, and then the main section 31 runs around the first sliding member 162 of the right pulley assembly 16 and the first sliding member 162 of the left pulley assembly 16 twice.

Figure 13:
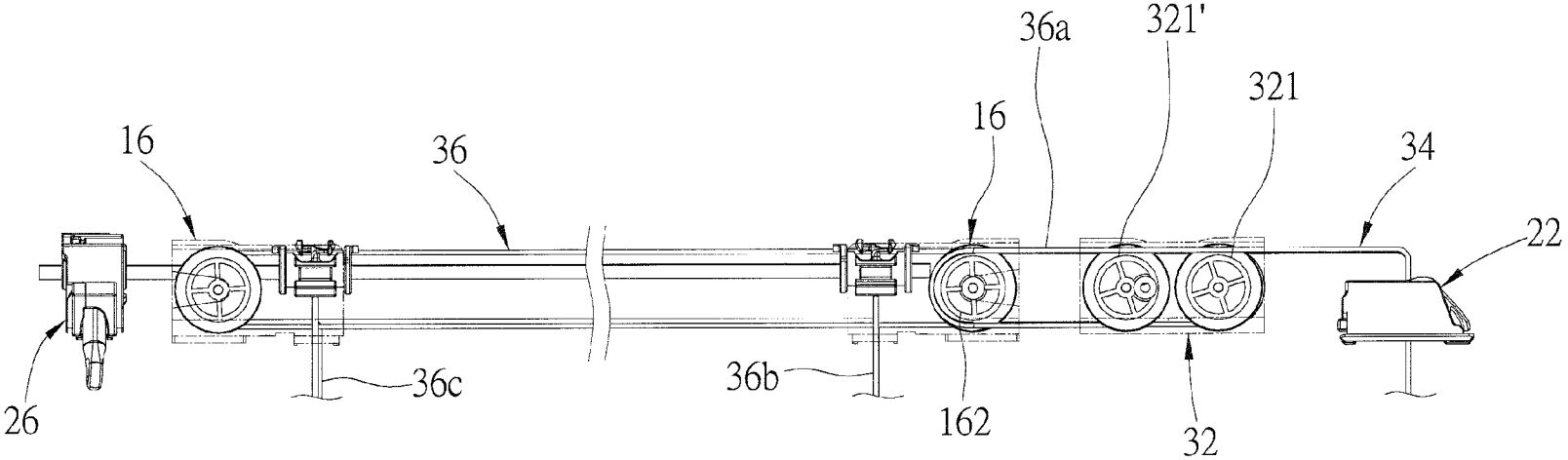
FIG. 13 is sketch diagram of a third preferred embodiment of the present invention, showing the mechanism in the headrail.
Figure 14:
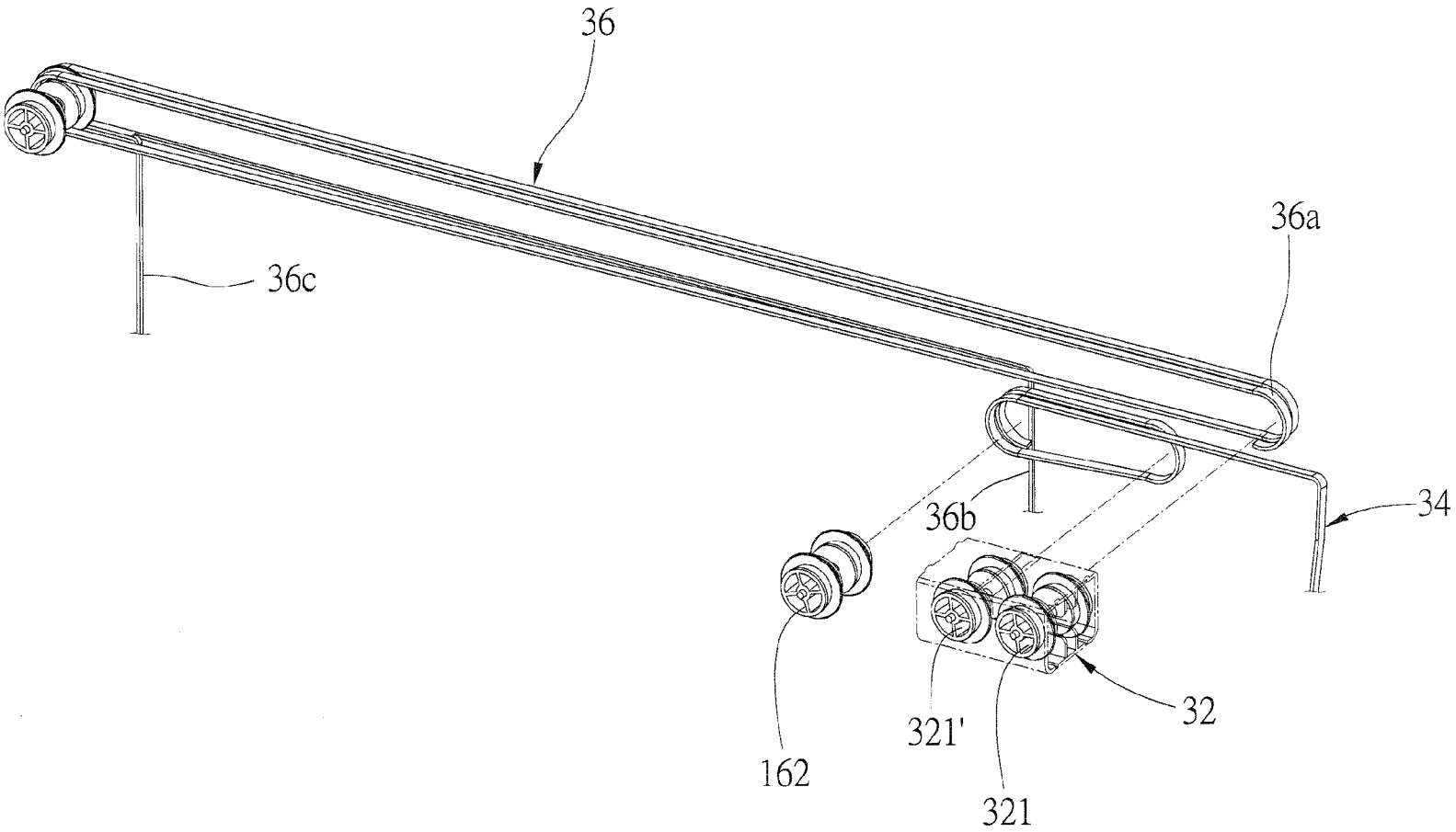
FIG. 14 a perspective view of the control cord and the transmission cord of the preferred embodiment of the present invention as shown in FIG. 13.

In the first preferred embodiment, the car 18 moves between the pulley assemblies 16. FIG. 13 and FIG. 14 show a window covering of the third preferred embodiment of the present invention, in which a car 32 is located between the right pulley assembly 16 and the cord lock 22 for reciprocation therebetween. A control cord 34 has an end fastened to a second sliding member 321' of the car 32 (it could fastened to another second sliding member 321 in another embodiment), runs around the first sliding member 162, passes through the cord lock 22, and then goes out of the headrail (not shown). A transmission cord 36 has an end of a main section 36*a* fastened to another second sliding member 321 of the car 32, and two branch sections 36*b*, 26*c* passing through the pulley assemblies 16 respectively, going out of the headrail, passing through the slats, and then connected to the bottom rail. With such structure, bottom rail and the slats of the window covering of the third preferred embodiment will be lifted and lowered faster or easier.

In previous embodiments, the control cord and the transmission cord are fastened to the second sliding members of the car respectively, and the second sliding members are wheels. In an embodiment, the second sliding members are two reels fixed to the car, and each reel is provided with a flange just like FIG. 6 to separate the control cord and the transmission cord. In an embodiment, the control cord and the transmission cord are fastened to the same first sliding member of the pulley assembly or the first sliding members of the pulley assemblies respectively according to the weight of the shading member, a distance for moving the bottom rail, and the designed force for the user to exert.

Figure 16:
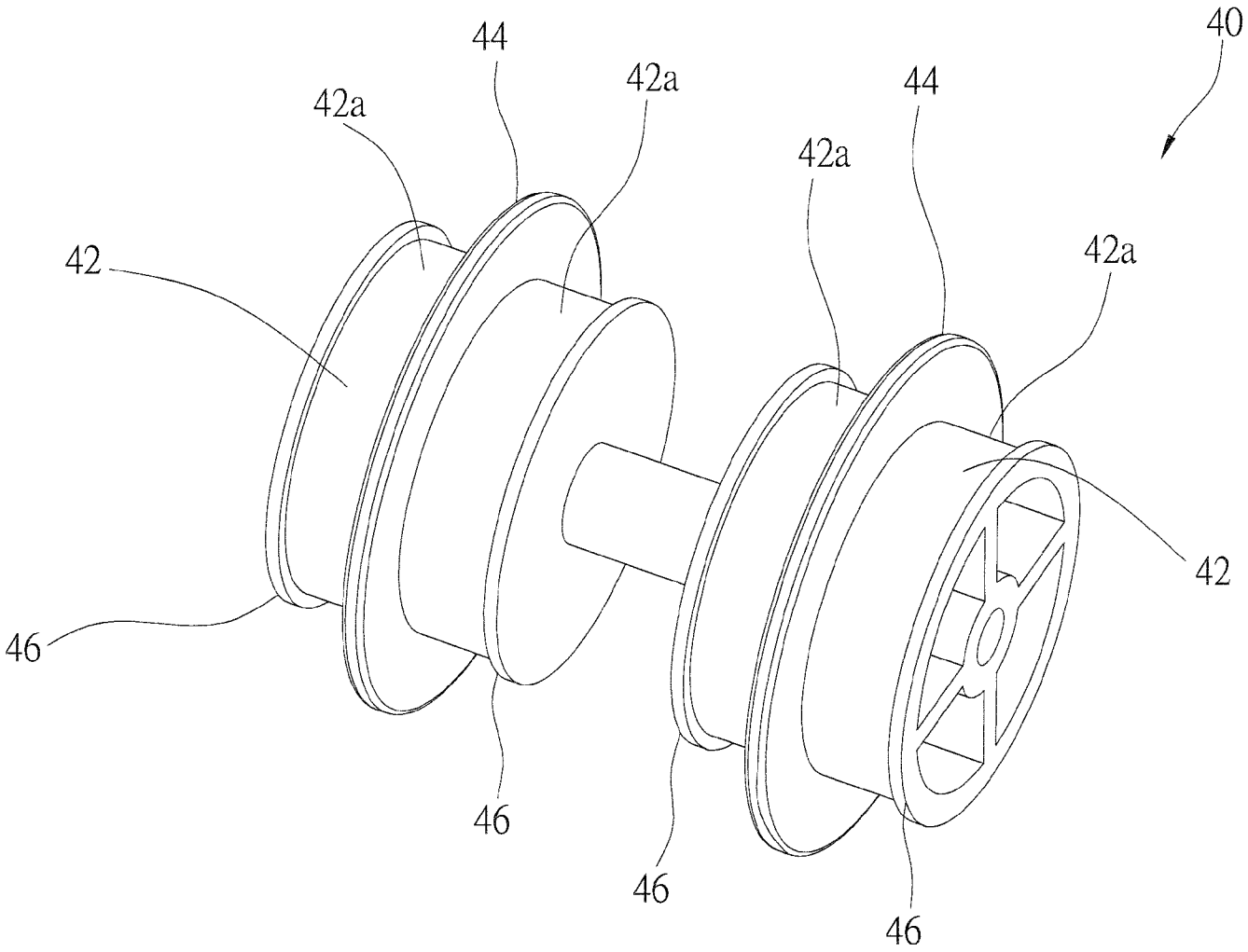
FIG. 16 is a perspective view of the sliding member with the flange.

FIG. 16 shows a sliding member 40 including a flange 42 at a middle of a tread and two edge flanges 46 at opposite edges of the tread. The same as above, a cord tread 42*a* is formed between the flange 42 and each edge flanges 46, but the cord treads 42*a* are horizontal (no slope). The edge flanges 46 block the cords wound on the cord treads 42*a* to prevent the cords from escaping.

Figure 15:
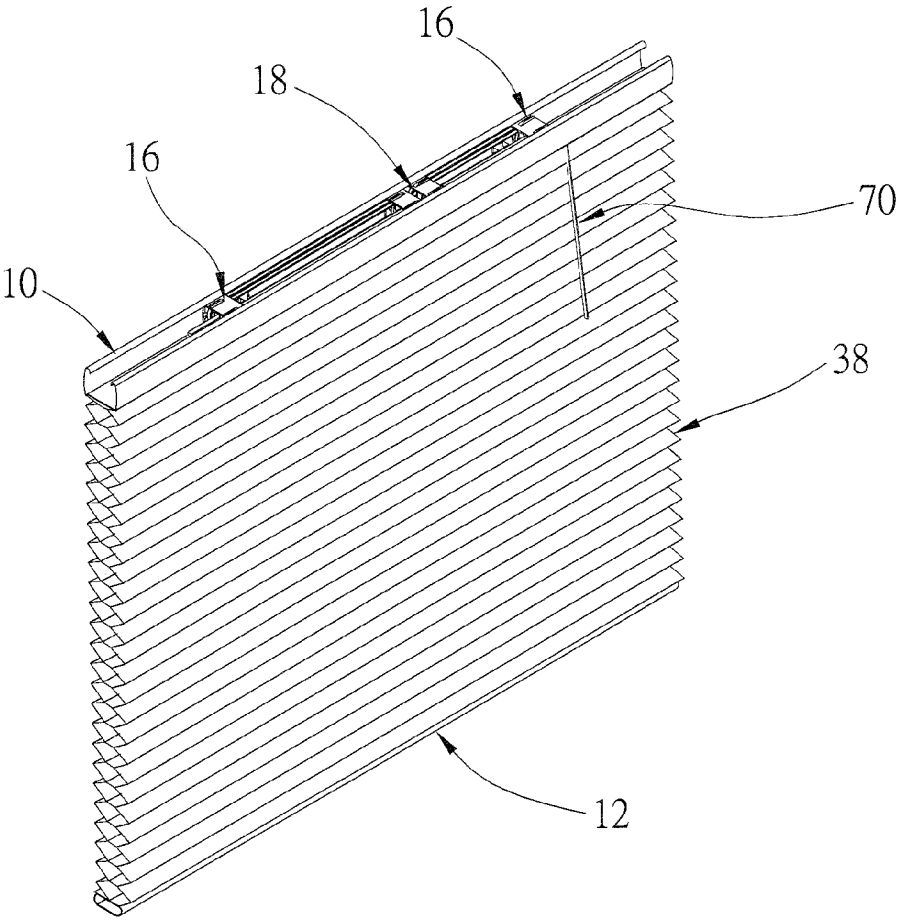
FIG. 15 is a perspective view of the window covering of a fourth preferred embodiment of the present invention.

The shading member may be a cellular shade 38 as shown in FIG. 15 to replace the blind in the previous embodiments. For the cellular shade 38, no tilting assembly and ladders are needed, and the cellular shade 38 is folded or unfolded by operating the control cord only.

It must be pointed out that the embodiments described above are only some preferred embodiments of the present invention. All equivalent structures which employ the concepts disclosed in this specification and the appended claims should fall within the scope of the present invention.

What is claimed is:

1. A window covering, comprising:

a headrail;

a bottom rail;

a shading member between the headrail and the bottom rail;

two pulley assemblies received in the headrail, wherein each of the two pulley assemblies has a first sliding member;

a car received in the headrail for reciprocation, and having two second sliding members;

a control cord running around the first sliding member of one of the pulley assemblies and one of the second sliding members of the car to form a plurality of loops, and then going out of the headrail, the first sliding member of one of the pulley assemblies and one of the second sliding members of the car are surrounded by each of the plurality of loops; and a transmission cord having two branch sections, wherein the transmission cord runs around both the first sliding member of the other one of the pulley assemblies and the other one of the second sliding members of the car, the two branch sections go out of the headrail to be connected to the bottom rail;

wherein the transmission cord further has a main section; both the branch sections are connected to an end of the main section; the main section runs around the first sliding member of the other one of the pulley assemblies and the other one of the second sliding member of the car.

2. The window covering of claim 1, further comprising a cord lock to hold or release the control cord.

3. The window covering of claim 1, wherein the main section and the branch sections are made by sewing, knotting, bonding, or gluing a plurality of filaments.

4. The window covering of claim 1, wherein the main section and the branch sections are flat.

5. The window covering of claim 1, further comprising a separating member between the branch sections.

6. The window covering of claim 1, wherein the car further has a second frame, in which the two second sliding members are received.

7. The window covering of claim 1, wherein each of the pulley assemblies further has a first frame, in which the respective first sliding member is received; each first frame has an opening for a respective one of the two branch sections of the transmission cord to pass through.

8. The window covering of claim 7, further comprising a tilting assembly and two ladders, wherein the tilting assembly has two fixed cores, a shaft, and a control unit; the fixed cores are received in the headrail; the shaft is connected to the fixed cores; an end of the shaft passes through the corresponding fixed core, and then is connected to the control unit; the ladders have ends connected to fixed cores respectively, and then pass through the shading member to be connected to the bottom rail.

9. The window covering of claim 8, wherein the first frame of each of the pulley assemblies further includes a carrying portion to receive the fixed core.

10. The window covering of claim 7, wherein the first frame of each of the pulley assembly is provided with two locking slots at an inner side thereof; each of the first sliding members has a wheel and a flange on a tread of the wheel; each of the flange engages the two locking slots of the respective first frame; each of the flange divides the tread of the wheel of the respective first sliding member into two cord treads, and the control cord runs around the two cord treads of the first sliding member of one of the pulley assemblies, and the transmission cord runs around the two cord treads of the first sliding member of the other one of the pulley assemblies.

11. The window covering of claim 10, wherein each of the two cord treads of the respective first sliding member slopes toward the flange.

12. The window covering of claim 10, wherein each wheel of the respective first sliding member further has two edge flanges at opposite edges of the tread of each wheel.

13. The window covering of claim 10, wherein the first frame of each of the pulley assemblies further has two second locking slots on the inner side; an axle, which is connected to the respective first sliding member, having opposite ends engaging the second locking slots respectively.

14. The window covering of claim 13, wherein each of the second locking slots has an open end and a closed end; a width at the open end is wider than that at the closed end; the axle engages the second locking slot via the open end and stops at the closed end.

* * * * *